US012012258B2

(12) United States Patent
Lewandowski et al.

(10) Patent No.: US 12,012,258 B2
(45) Date of Patent: Jun. 18, 2024

(54) CONTAINER LID

(71) Applicant: REEND SPOLKA Z OGRANICZONA ODPOWIEDZIALNOSCIA, Krzemieniewo (PL)

(72) Inventors: Dariusz Lewandowski, Warsaw (PL); Michał Prałat, Wilkowice (PL)

(73) Assignee: REEND SPOLKA Z OGRANICZONA ODPOWIEDZIALNOSCIA, Krezemieniewo (PL)

( * ) Notice: Subject to any disclaimer, the term of this patent is extended or adjusted under 35 U.S.C. 154(b) by 0 days.

(21) Appl. No.: 18/276,228

(22) PCT Filed: Apr. 26, 2021

(86) PCT No.: PCT/PL2021/000026
§ 371 (c)(1),
(2) Date: Aug. 7, 2023

(87) PCT Pub. No.: WO2022/173317
PCT Pub. Date: Aug. 18, 2022

(65) Prior Publication Data

US 2024/0034524 A1 Feb. 1, 2024

(30) Foreign Application Priority Data

Feb. 10, 2021 (PL) ..... 436924

(51) Int. Cl.
*B65D 47/28* (2006.01)
*B65D 43/02* (2006.01)
(Continued)

(52) U.S. Cl.
CPC ..... *B65D 47/286* (2013.01); *B65D 43/20* (2013.01); *B65D 51/1672* (2013.01);
(Continued)

(58) Field of Classification Search
CPC ..... B65D 47/286; B65D 2543/00046; B65D 43/20
(Continued)

(56) References Cited

U.S. PATENT DOCUMENTS 4,819,829 A * 4/1989 Rosten ..... B65D 5/727 220/345.3
6,354,454 B1 * 3/2002 Wong ..... B65D 47/263 215/322
(Continued)

FOREIGN PATENT DOCUMENTS

PL 429610 A1 10/2020
WO 2010094793 A2 8/2010
(Continued)

OTHER PUBLICATIONS

Written Opinion of the International Searching Authority and International Search Report issued by European Patent Office for corresponding International Patent Application No. PCT/PL2021/000026, dated Mar. 11, 2021.

*Primary Examiner* — James N Smalley
(74) *Attorney, Agent, or Firm* — Myers Wolin, LLC

(57) ABSTRACT

A container lid having a panel with an opening for emptying a container, where formed on two opposite walls of the said opening are guides declining towards the bottom surface of the panel, and further having a slide piece with catches formed on the top surface of the slide piece declining towards the top surface of the slide piece, said slide piece further featuring a pull tab, where the said catches are fitted slidingly in the said guides, where the pull tab is formed on the top surface of the slide piece, and where a recess to accommodate the slide piece is formed on the bottom surface of the panel around the opening for emptying the container.

17 Claims, 16 Drawing Sheets

(51) Int. Cl.
*B65D 43/20* (2006.01)
*B65D 51/16* (2006.01)
*B65D 51/18* (2006.01)

(52) U.S. Cl.
CPC ..... *B65D 51/18* (2013.01); *B65D 43/0202* (2013.01); *B65D 2205/02* (2013.01); *B65D 2543/00046* (2013.01); *B65D 2543/00092* (2013.01)

(58) Field of Classification Search
USPC ..... 220/254.9, 345.4
See application file for complete search history.

(56) References Cited

U.S. PATENT DOCUMENTS

| | | | | |
|---|---|---|---|---|
| 6,824,003 | B1 * | 11/2004 | Wong | B65D 43/0202 220/254.9 |
| 7,845,510 | B2 * | 12/2010 | Schmidtner | B65D 47/286 220/717 |
| 2019/0256258 | A1 | 8/2019 | Levy et al. | |

FOREIGN PATENT DOCUMENTS

| | | | |
|---|---|---|---|
| WO | 2014003586 | A2 | 1/2014 |
| WO | 2020086567 | A1 | 4/2020 |
| WO | 2020209733 | A1 | 10/2020 |

* cited by examiner

CONTAINER LID

CROSS REFERENCE TO RELATED APPLICATIONS

The present application is a U.S. National Phase under 35 U.S.C. 371 of International Patent Application Serial No. PCT/PL2021/000026, filed on Apr. 26, 2021, which claims priority to Polish Application P.436924, filed on Feb. 10, 2021, the contents of each of which are incorporated by reference in their entirety for all purposes.

FIELD OF THE INVENTION

The invention concerns a lid for a container, particularly beverage container. The lid is made of plastic and can be used in containers made of plastic.

BACKGROUND

Known from patent document WO 2010/094793 A2 is a container lid, particularly of a beverage can, incorporating a reclosing mechanism of elastic material, fixed entirely to the bottom side of the cover and partially integrated therewith in a way which prevents its twisting, featuring an actuating mechanism fitted on the top side of the lid via an adapter. 9

Known from patent document WO 2014/003586 A2 is a reclosing mechanism for containers, particularly beverage containers, incorporating means for opening and reclosing the beverage outflow opening in the form of a latch fitted slidingly in the guides, where the latch touches on the bottom surface of the lid around the opening. On the top, the lid is fitted with a sliding pull tab on one side connected to the latch via a hinge and on the other connected to the latch via a connector which serves as the seal before the first opening, where on the side of the hinge and the pull tab front the lid features respective resistance surfaces which determine the initial position of the latch before the first opening.

Known from patent document PL 429 610 A1 is a lid of a container, particularly beverage container, having an opening for emptying the container, fitted with guides formed on two opposite walls and with a slide piece for opening and reclosing the said opening, where there are two catches formed on the top surface of the slide piece, the catches fitted slidingly in the opening in the said guides, and where the slide piece is fitted with technical means for shifting the slide piece from the closed position to the open position and backwards. The surfaces of the slide piece catches which cooperate with the guides are inclined at an acute angle with respect to the top surface of the slide piece. Formed on the bottom side of the lid around the opening is a socket for the slide piece with profiled surfaces to seal the slide piece when in the socket in the closed position formed around its circumference.

Pursuant to the principles of circular economy (CE) applicable to plastics effort should be taken to reduce the weight of the products, use materials which can be reused for the same purpose, and employ structural solutions which involve no detachable elements and in which all elements are made of the same material.

SUMMARY

The invention described herein solves the problems ensuing from the circular economy principles.

According to this invention, a container lid having a panel with an opening for emptying the container, where formed on the two opposite walls of the said opening are guides declining towards the bottom surface of the panel, and further having a slide piece with catches formed on the top surface of the slide piece declining towards the top surface of the slide piece, said slide piece further featuring a pull tab, where the said catches are fitted slidingly in the said guides, is characterised in that the pull tab is formed on the top surface of the slide piece, and there is a recess to accommodate the slide piece formed on the bottom surface of the panel around the opening for emptying the container, where formed in the said recess is at least one locking element and formed on the slide piece is at least one locking element, so that the said locking element of the panel and the said locking element of the slide piece fit one another forming a pair.

Preferably, the bottom surface of the slide piece is flat, and the bottom surface of the panel is flat at least in a portion around the recess.

Preferably, formed on the bottom surface of the slide piece are guides, and formed on the bottom surface of the panel are catches which are fitted slidingly in the said guides.

The guides formed on the two opposite walls in the opening run askew with respect to the bottom surface of the panel, and the catches formed on the top surface of the slide piece run askew with respect to the top surface of the slide piece, or the guides formed on the two opposite walls in the opening and the catches formed on the top surface of the slide piece are given the arched shape.

Preferably, the catches formed on the top surface of the slide piece are given the form of segments.

Preferably, the catches are formed on the opposite side walls of the pull tab.

Preferably, fixed to the bottom surface of the slide piece and the flat part of the bottom surface of the panel is plastic foil with a perforation at least along the longitudinal edges of the slide piece.

Preferably, there are spikes on the bottom surface of the slide piece, along the edge transverse with respect to the direction in which the slide piece moves.

Preferably, the locking element of the slide piece is given the form of a hollow, and the matching locking element of the recess in the panel is given the form of a protrusion.

Preferably, the panel features at least one opening to ensure the flow of air, and preferably the slide piece features at least one opening to ensure the flow of air, which overlaps the said opening in the panel, when the opening for emptying the container is uncovered. Preferably, formed on the bottom surface of the panel around its circumferential edge is a groove, the bottom of which may be either flat, or may feature an energy director, preferably triangular in cross section, or preferably, on the bottom surface of the panel around its circumferential edge can be an energy director, preferably triangular in cross section. The technical means named above are suitable for ultrasonic welding of the lid and the container. Preferably, formed on the top surface of the panel is an outflow lip. The lid is made of plastic.

The solution according to the said invention ensures integrity of its components, reduction of the number of parts making up the lid to two elements, i.e. the panel and the slide piece, thanks to which the weight is lower than in other known solutions. The profile of the rim of the bottom surface of the panel enables non-detachable connection between the lid and the container by way of ultrasonic welding. The homogeneity of the material used to make the lid panel, the slide piece for opening and reclosing of the opening for emptying the container, and the possibility to achieve non-detachable connection between the lid and the container made of the same material as the lid all enable easy recycling and make it possible to avoid thread connections. Moreover, thanks to elimination of the friction between the slide piece and the panel the opening and reclosing of the opening for emptying the container can be achieved in a single movement using the force of a single finger. The use of locking elements in the form of hollows and protrusions which cooperate with each other while the opening for emptying the container is being opened and reclosed, secures the slide piece against its undesired movement and ensures tight reclosing of the opening for emptying the container.

Moreover, the structure of the lid makes it possible to use foil as the material sealing the opening for emptying the container.

BRIEF DESCRIPTION OF THE DRAWINGS

These and other characteristics of the invention will be clear from the following description of a preferential form of embodiment, given as a non-restrictive example, with reference to the attached drawings wherein.

DETAILED DESCRIPTION OF THE PREFERRED EMBODIMENTS

Figure 11:
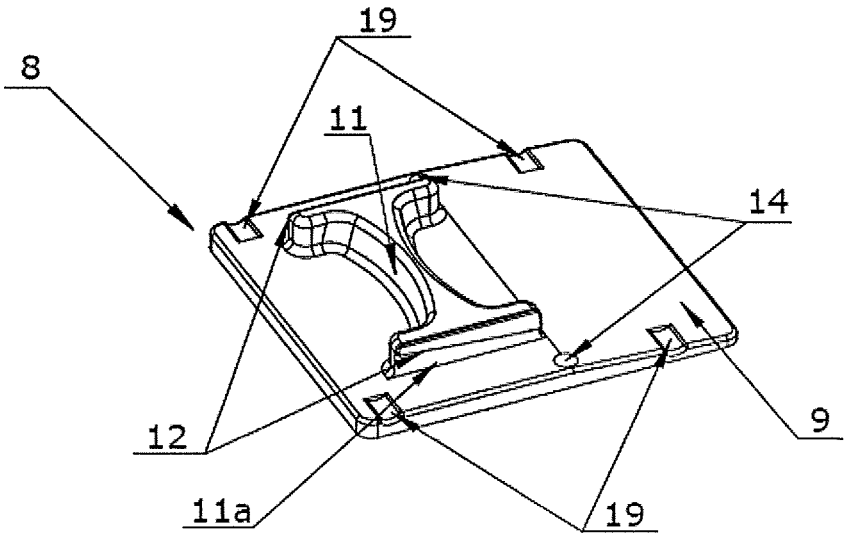
FIG. 11 shows the slide piece in a 3D view from the top.
Figure 12:
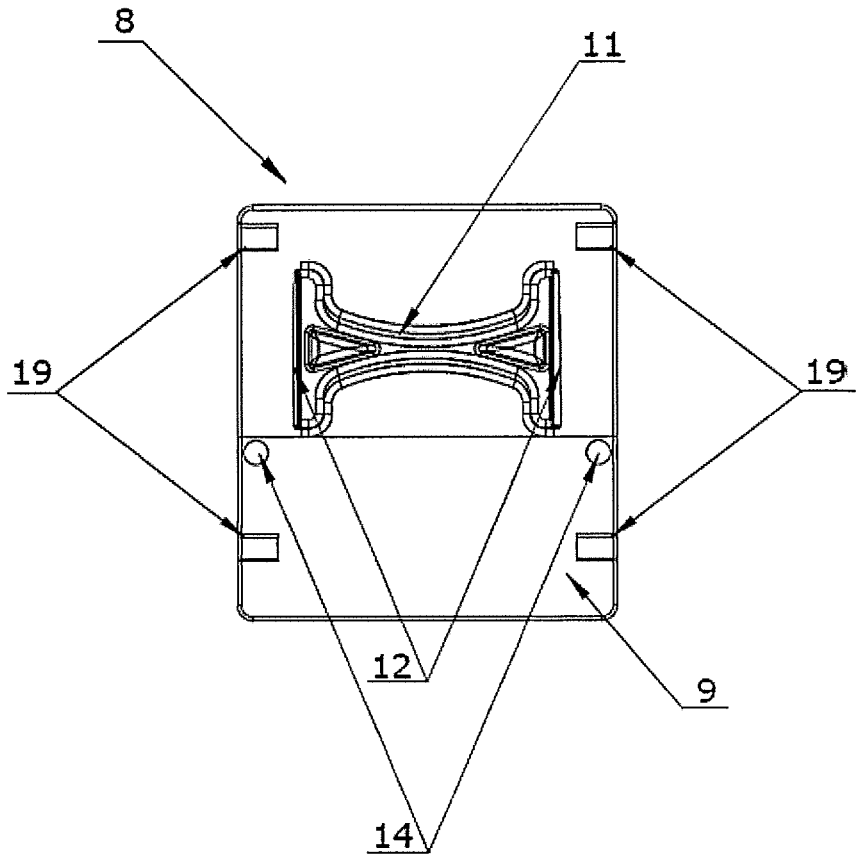
FIG. 12 presents the slide piece in a view from the top.
Figure 13:
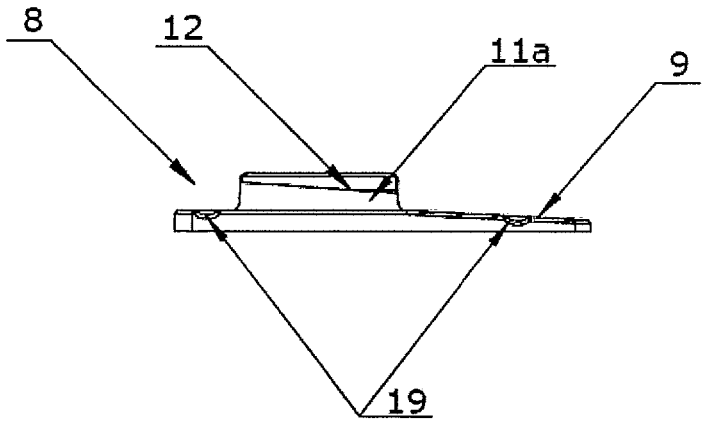
FIG. 13 depicts the slide piece in a view from the side.
Figure 14:
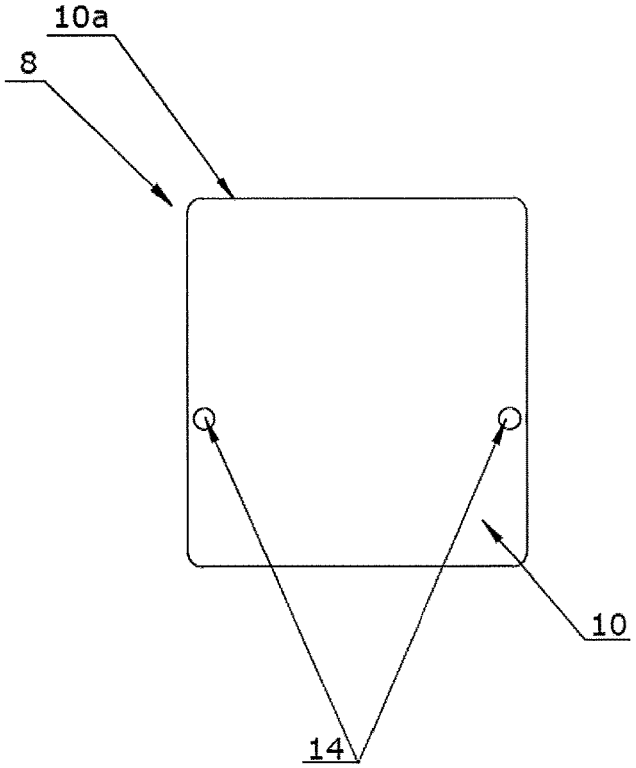
FIG. 14 shows the slide piece in a view from the bottom.
Figure 15:
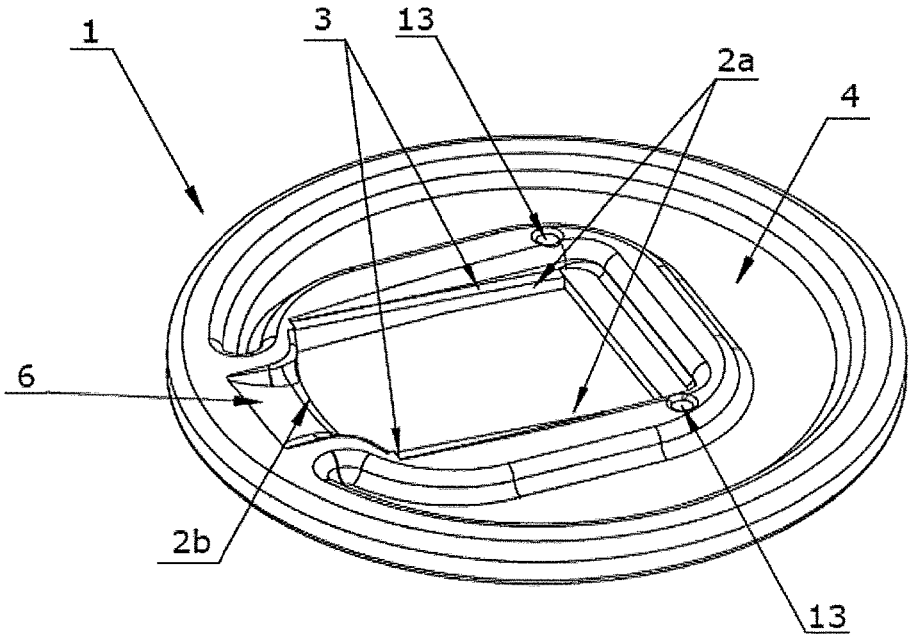
FIG. 15 depicts the panel in a 3D view from the top.
Figure 16:
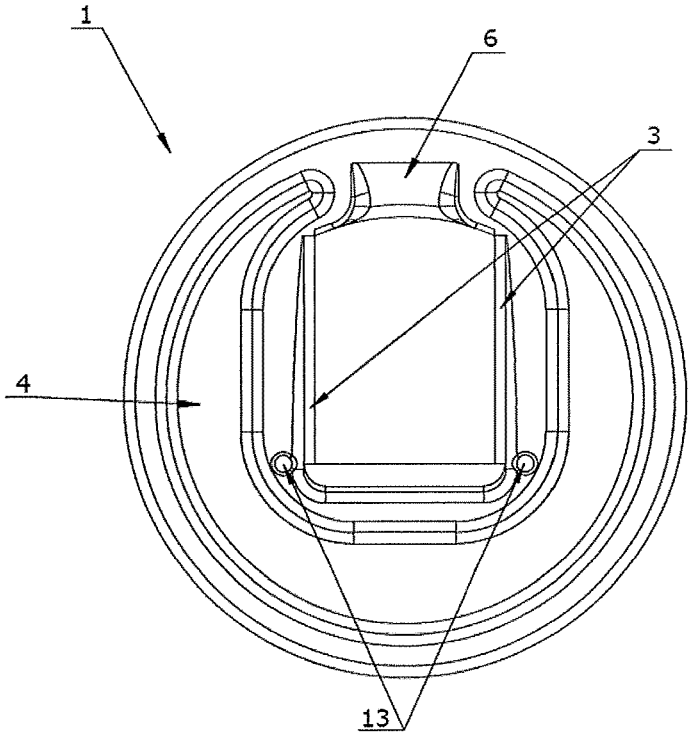
FIG. 16 shows the panel in a view from the top.
Figure 17:
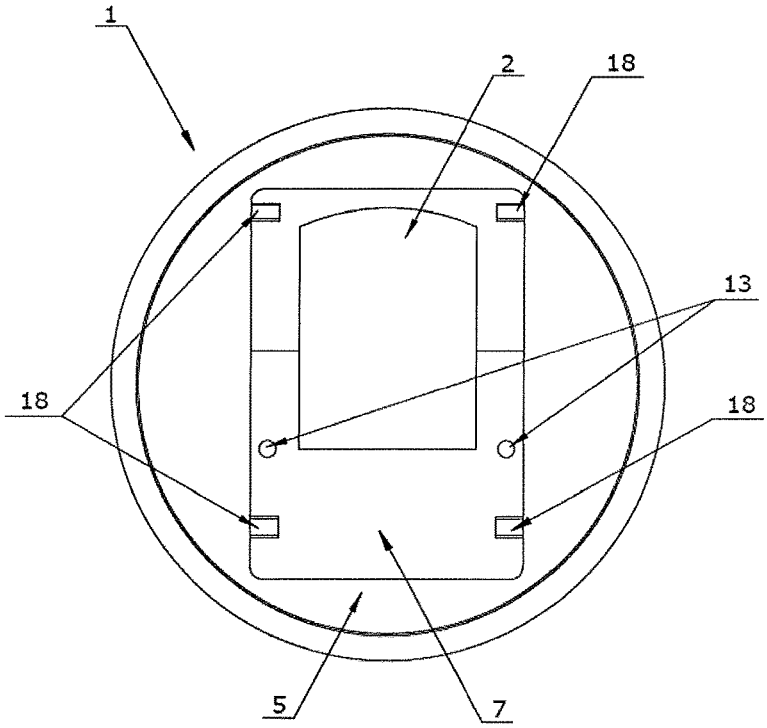
FIG. 17 presents the panel in a view from the bottom.

In the invention embodiment shown in FIG. 1 to FIG. 17, a lid of the container, particularly a container designated for beverages, features a panel 1 with an opening 2 for emptying the container, and a slide piece 8 for opening and reclosing the said opening 2. Formed in the opening 2, on the opposite longitudinal walls 2*a*, askew with respect to the bottom surface 5 of the panel 1, are guides 3 declining towards the bottom surface 5 of the panel 1. Formed on the top surface 4 of the panel 1, along the transverse edge 2*b* of the opening 2, is an outflow lip 6. The bottom surface 5 of the panel 1 is flat around the opening for emptying the container, where the said flat part features a recess 7 to accommodate the slide piece 8 (FIG. 4, FIG. 6, FIG. 7, FIG. 8, FIG. 8A, FIG. 8B, FIG. 8C, FIG. 8D, FIG. 9). Formed on the top surface 9 of the slide piece 8 is a protruding pull tab 11, where formed on the opposite side walls 11*a* of the pull tab, askew with respect to the top surface 9 of the slide piece 8, are catches 12 declining towards the top surface 9 of the slide piece. The bottom surface 10 of the slide piece 8 is flat. The slide piece 8 is positioned in the recess 7, and the catches 12 are fitted slidingly in the guides 3. Formed on the top surface 9 of the slide piece 8 is a locking element 19 in the form of a hollow, and formed in the recess 7 of the panel 1 is, correspondingly, a locking element 18 in the form of a protrusion which cooperates with the said hollow when the slide piece 8 is actuated. Shown in FIG. 11, FIG. 12 are four hollows 19 formed on the top surface of the slide piece 8, and presented in FIG. 17 are four protrusions 18 formed, correspondingly, on the bottom surface of the panel 1, in the recess 7. The said hollows and protrusions are arranged in matching pairs which stabilise the slide piece 8 in the closed position and open position, respectively, and secure the slide piece 8 against undesirable movement. In order to supply air to the container during its emptying, the panel 1 and the slide piece 8 may feature e.g. two pairs of openings 13, 14. In the initial position, when the opening 2 for emptying the container is closed, the openings 13 in the panel 1 are screened with the slide piece 8, whereas when the opening 2 for emptying the container is open, the openings 13 in the panel 1 overlap the openings 14 in the slide piece 8, forming an air inlet into the container when it is being emptied.

Figure 1:
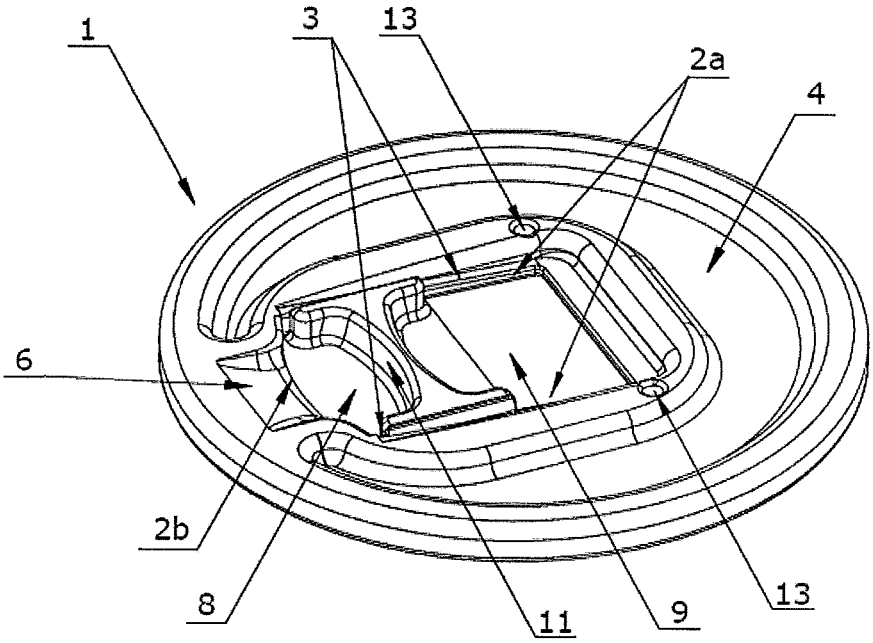
FIG. 1 shows the lid with opening for emptying the container in the closed position, in a 3D view from the top.
Figure 2:
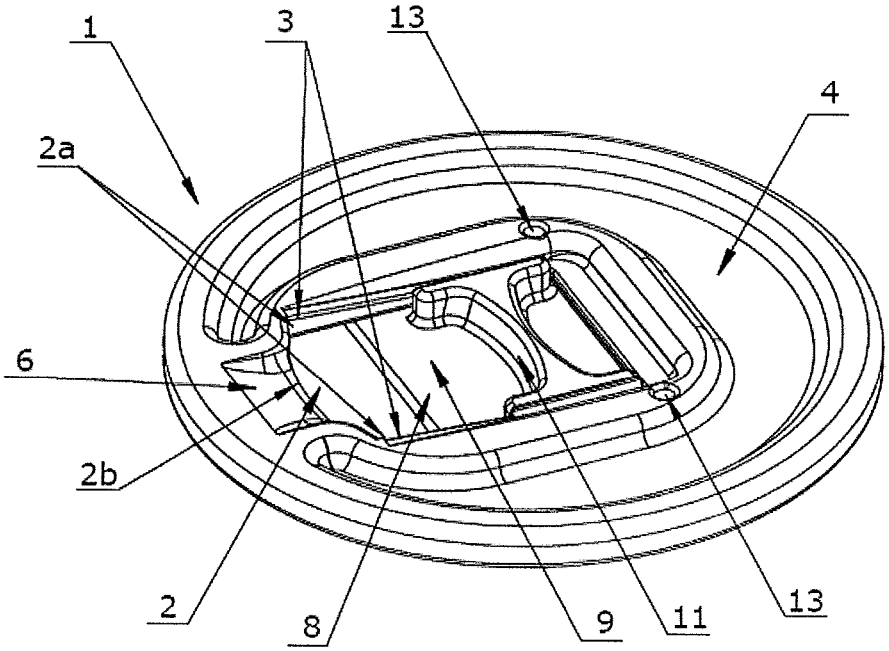
FIG. 2 presents the lid with the opening for emptying the container in the open position, in a 3D view from the top.
Figure 3:
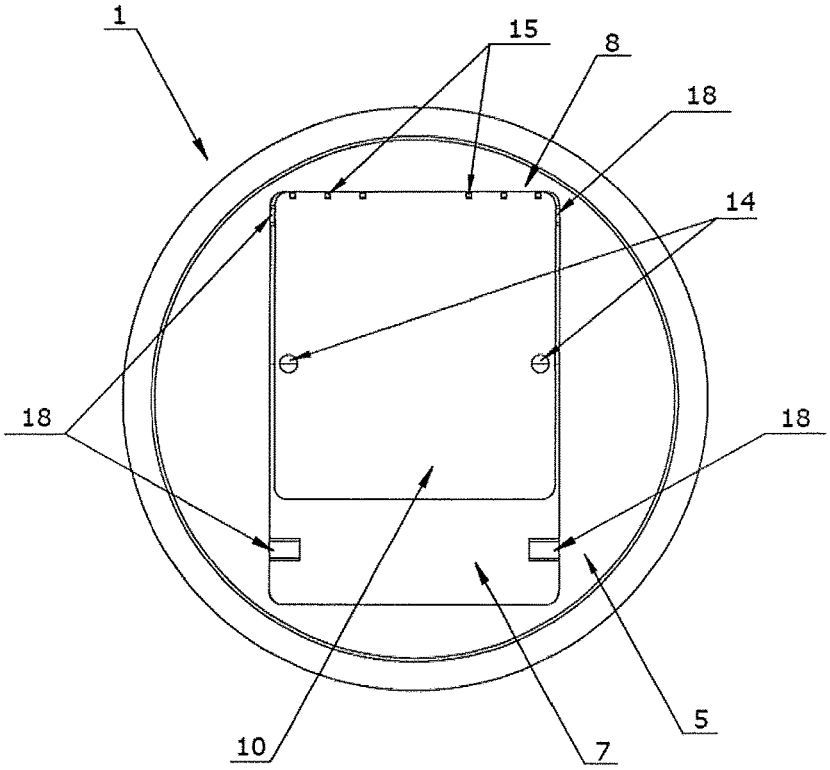
FIG. 3 depicts the lid with the opening for emptying the container in the closed position, in a view from the bottom.
Figure 3A:
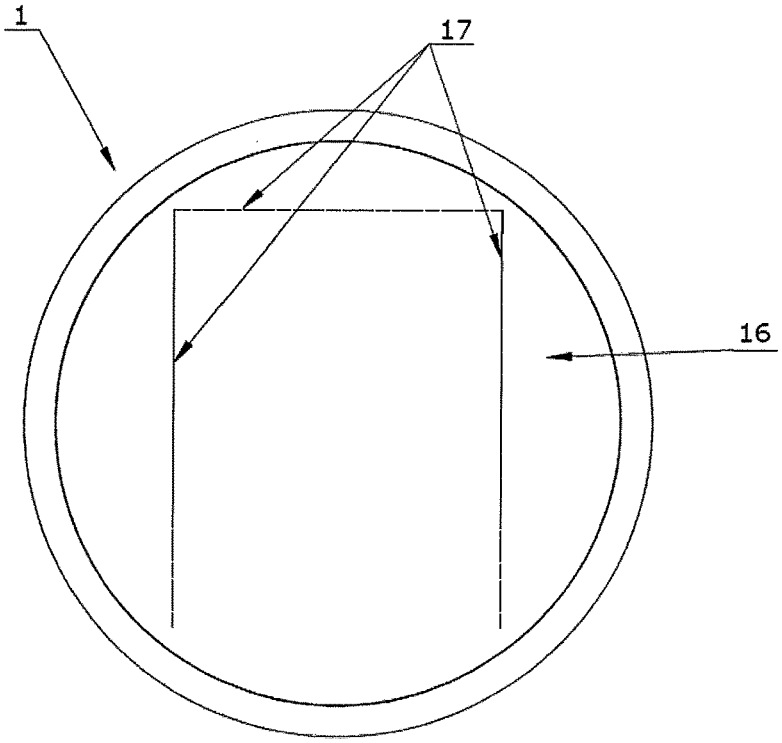
FIG. 3A shows the lid with the opening for emptying the container in the closed position, with plastic foil fixed in place, in a view from the bottom.

In one of the embodiments, when the opening 2 is closed with the slide piece 8, its bottom surface 10 may be positioned in the plane defined by the bottom flat surface 5 of the panel 1 around the opening 2, and then fixed to both surfaces 5, 10 mentioned above as an additional element may be plastic foil 16 so as to seal the opening 2 for emptying the container. The foil 16 features perforation 17 along the bottom longitudinal edges of the slide piece 8 and along the transverse edge 10*a*, as shown in FIG. 3A. In this case, on the slide piece 8, on the bottom surface along its edge 10*a* transverse with respect to the direction in which the slide piece 8 moves, formed may be spikes 15, which facilitate breaking the foil along the perforation 17, as shown in FIG. 3.

In another embodiment shown in FIG. 23 to FIG. 26, there is no foil fixed to the lid described above, but formed on the bottom surface 10 of the slide piece 8 are guides 23, and formed on the bottom surface 5 of the panel 1 are catches 22 which are fitted slidingly in the said guides 23. The above guides 23 and catches 22 stabilise the movement of the slide piece 8.

Figure 18:
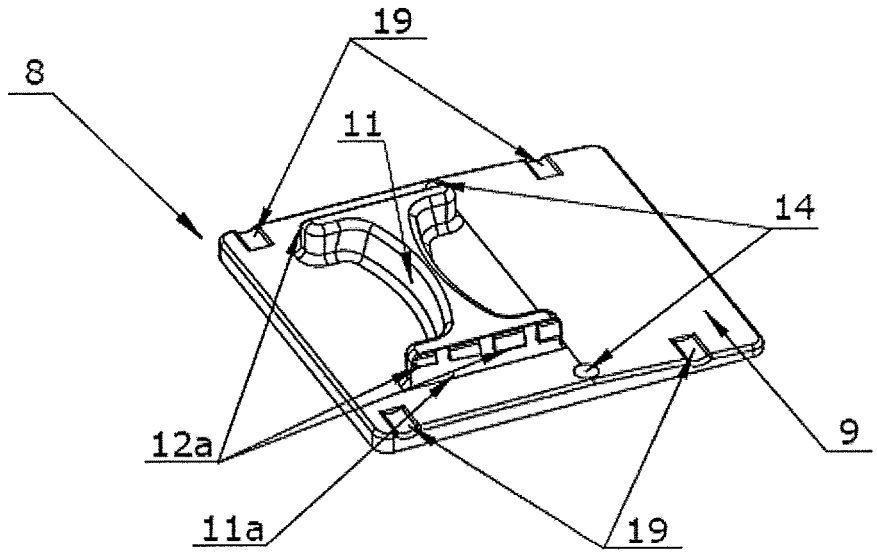
FIG. 18 depicts the slide piece with slanting catches in the form of segments, in a 3D view.

In another embodiment, the lid is different from the lid described in the first embodiment in that the catches formed on the top surface 9 of the slide piece 8 are given the form of segments 12*a*, as shown in FIG. 18.

Figure 19:
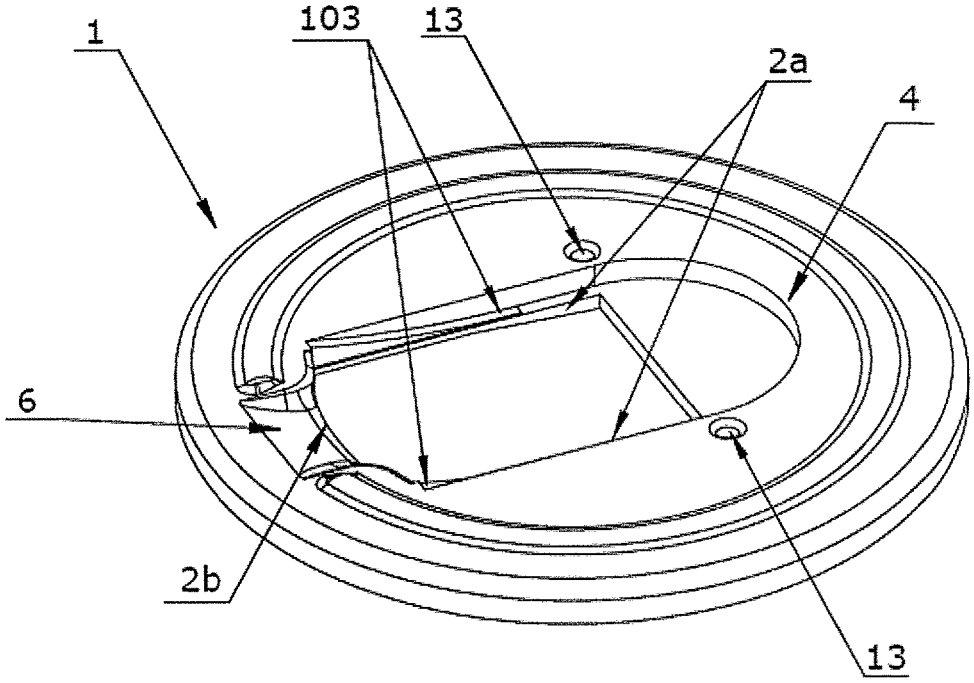
FIG. 19 presents the panel with arched guides, in a 3D view.
Figure 20:
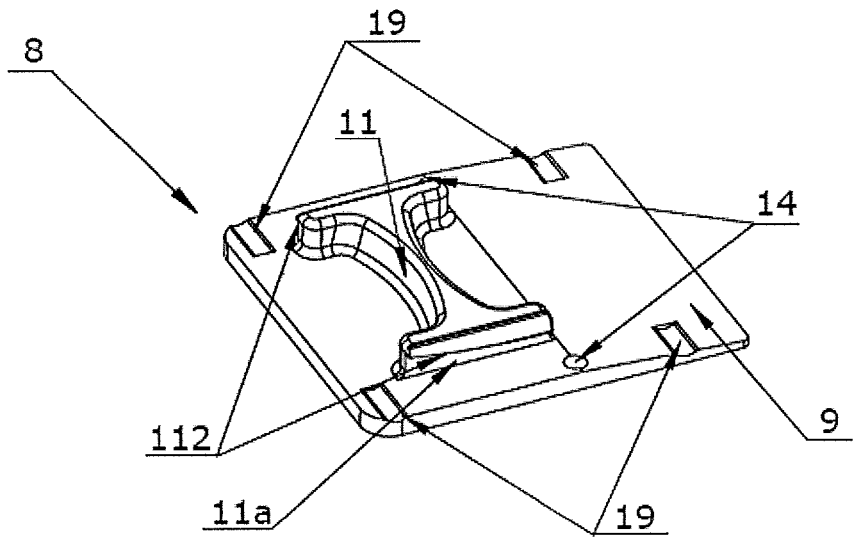
FIG. 20 depicts the slide piece with arched catches, in a 3D view.
Figure 21:
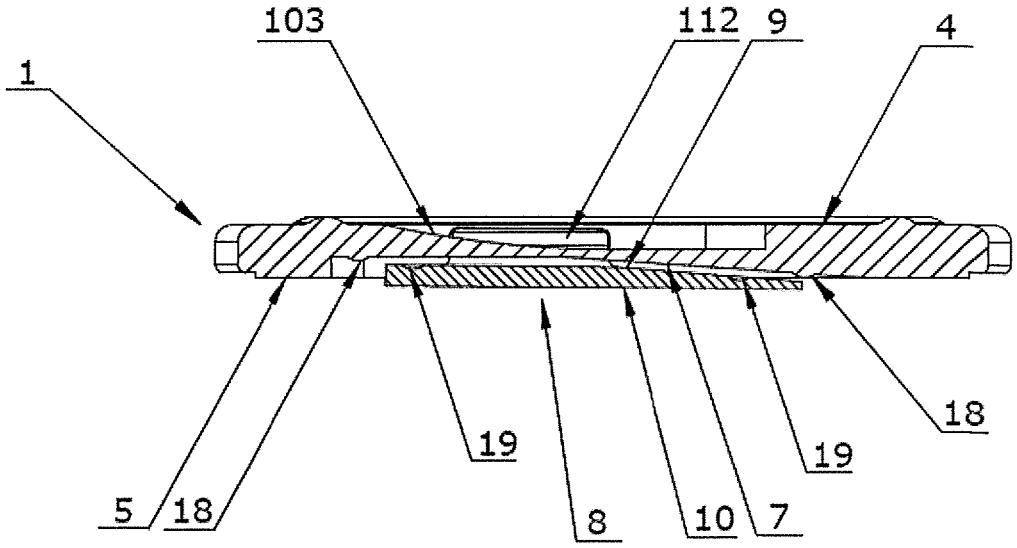
FIG. 21 shows the lid with the open opening for emptying the container, in cross section across the guide as in FIG. 19.
Figure 22:
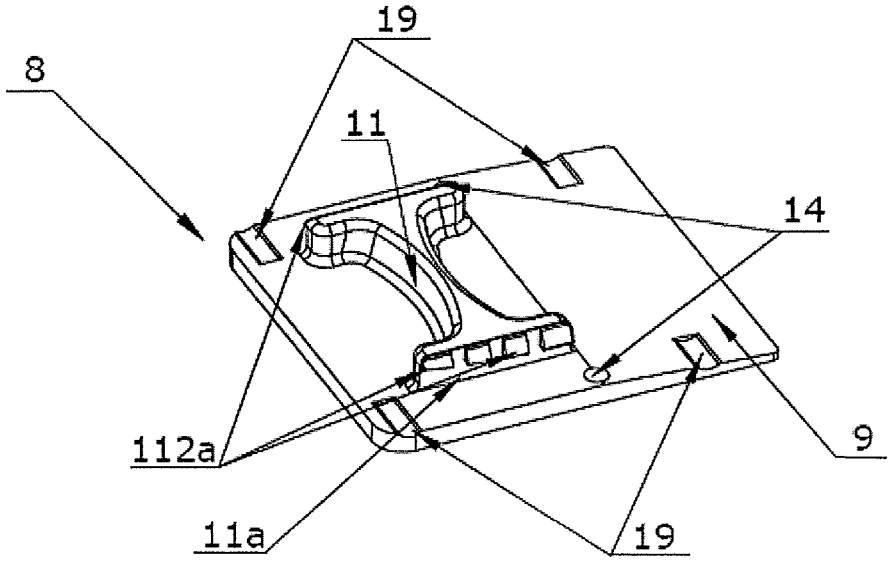
FIG. 22 presents the slide piece with catches in the form of arched segments, in a 3D view.
Figure 23:
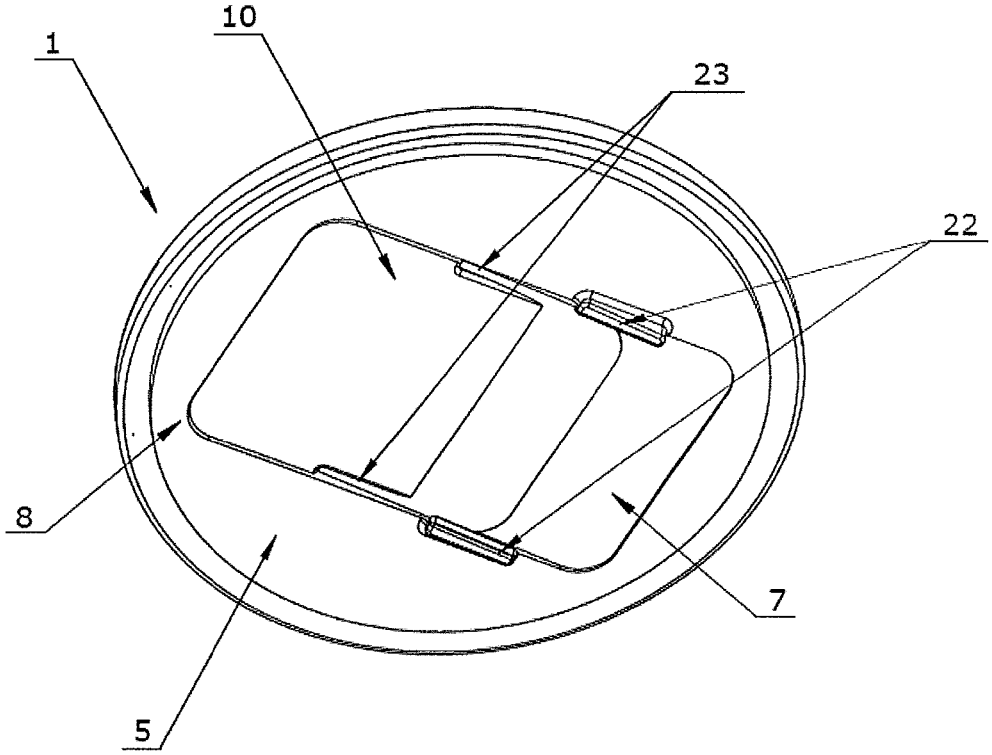
FIG. 23 shows the lid with additional guides and catches, with the opening for emptying of the container in the closed position, in a 3D view from the bottom.
Figure 24:
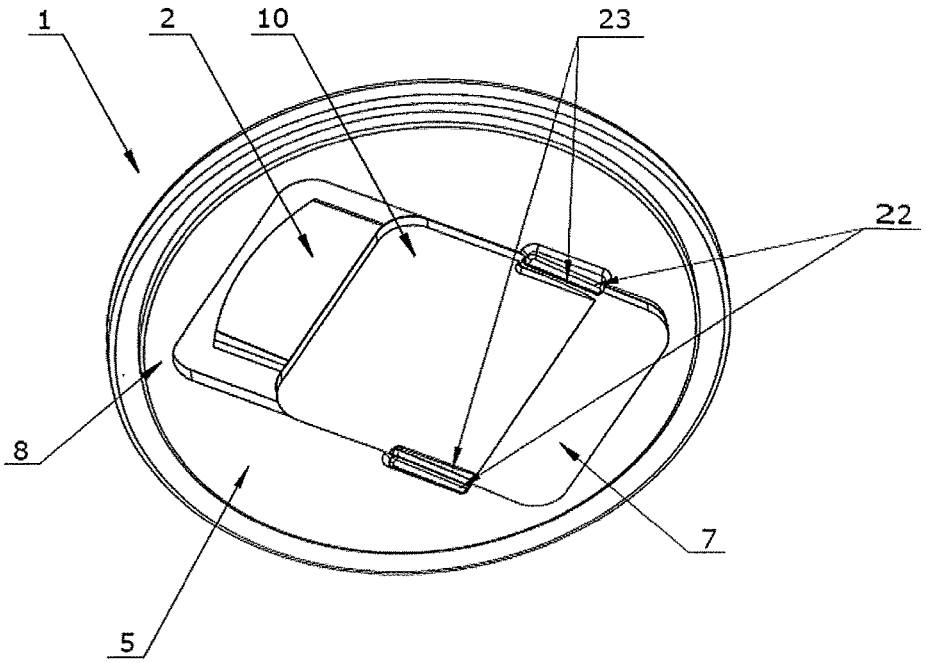
FIG. 24 presents the lid with additional guides and catches, with the opening for emptying the container in the open position, in a 3D view from the bottom.
Figure 25:
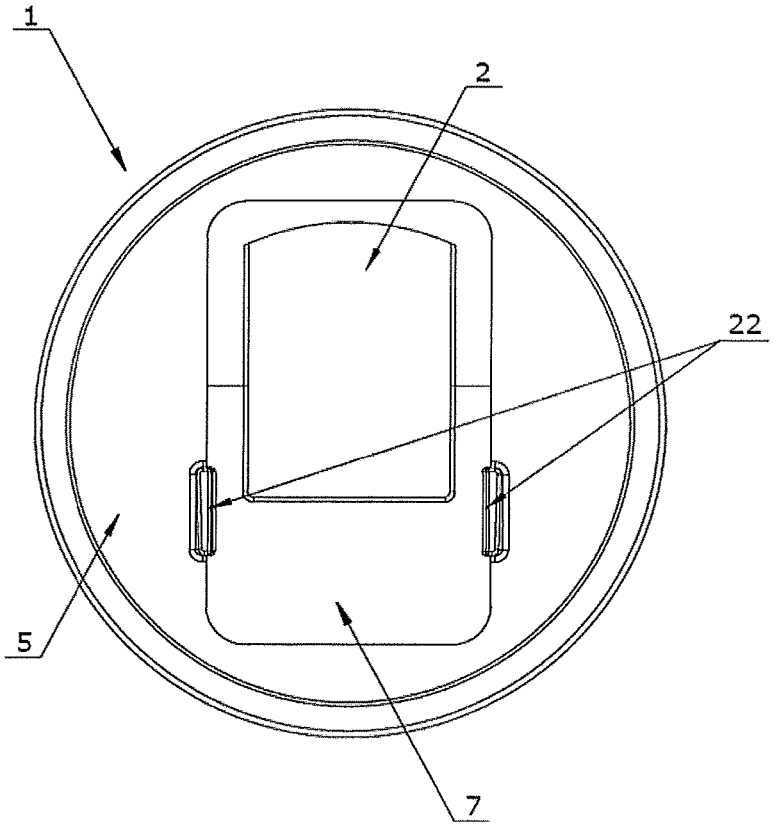
FIG. 25 depicts the panel with the catches in a view from the bottom.
Figure 26:
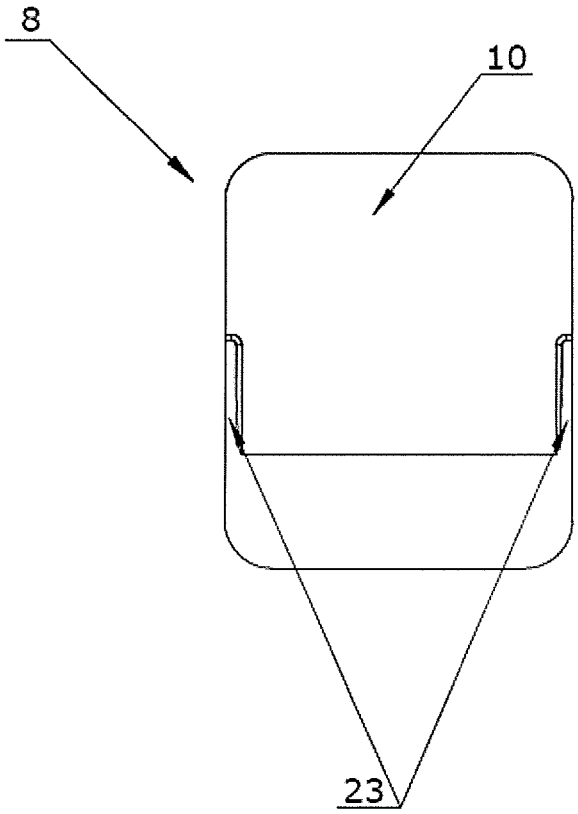
FIG. 26 shows the slide piece with guides, viewed from the bottom.

In yet another embodiment, the lid is different from the one described above in the first embodiment in that the guides 103 and catches 112 are given the arched shape, as shown in FIG. 19, FIG. 20 and FIG. 21, where the catches can take the form of segments 112*a*, as shown in FIG. 22.

Figure 8:
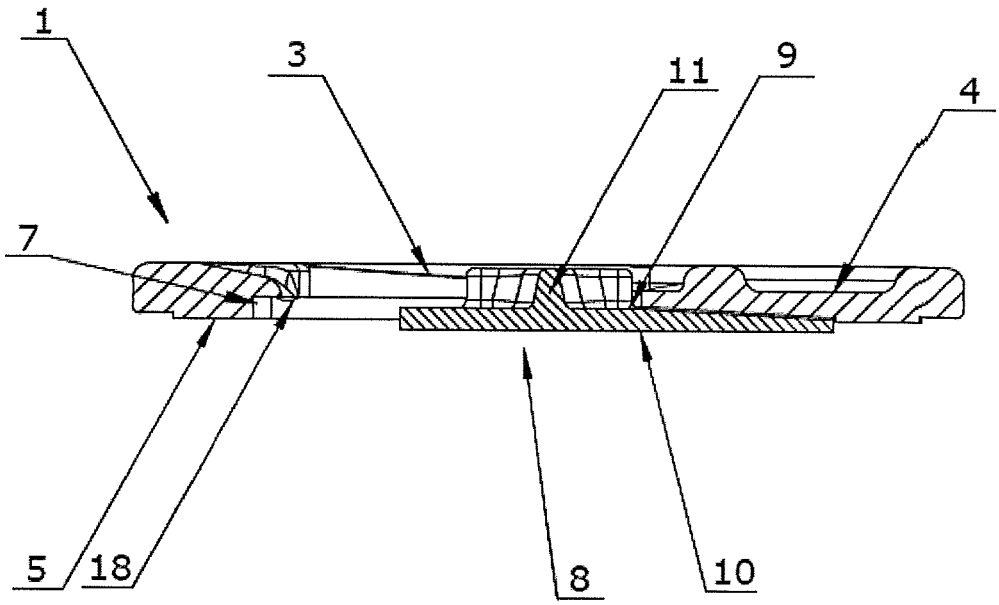
FIG. 8 presents the lid with the opening for emptying the container in the open position, in longitudinal section in between the guides.
Figure 8A:
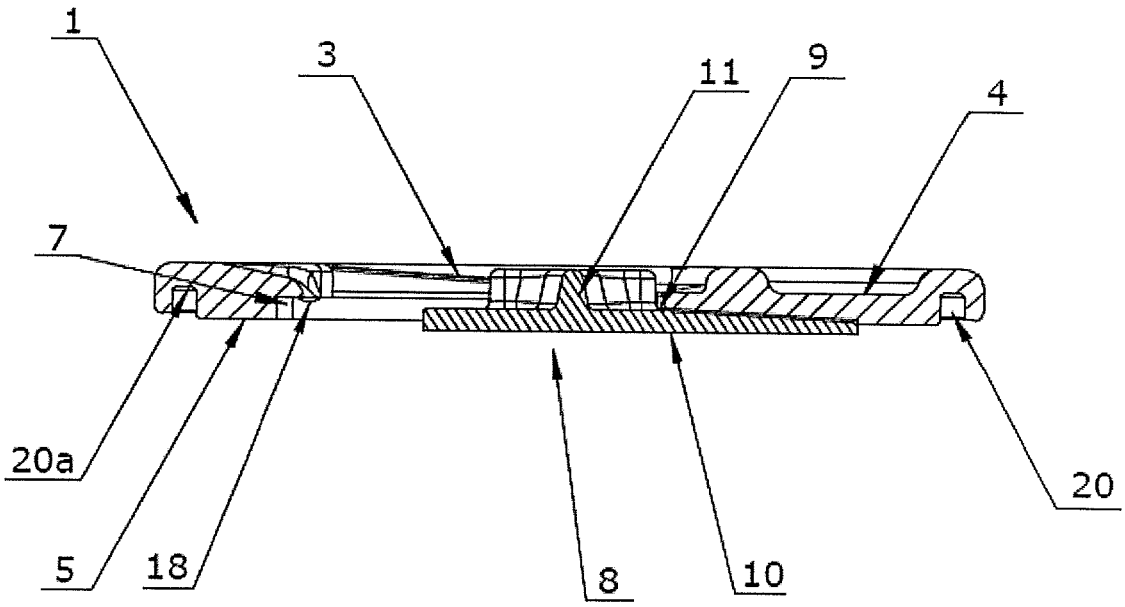
FIG. 8A to FIG. 8D shows the lid as in FIG. 8 with the rim in various profile variants.
Figure 8B:
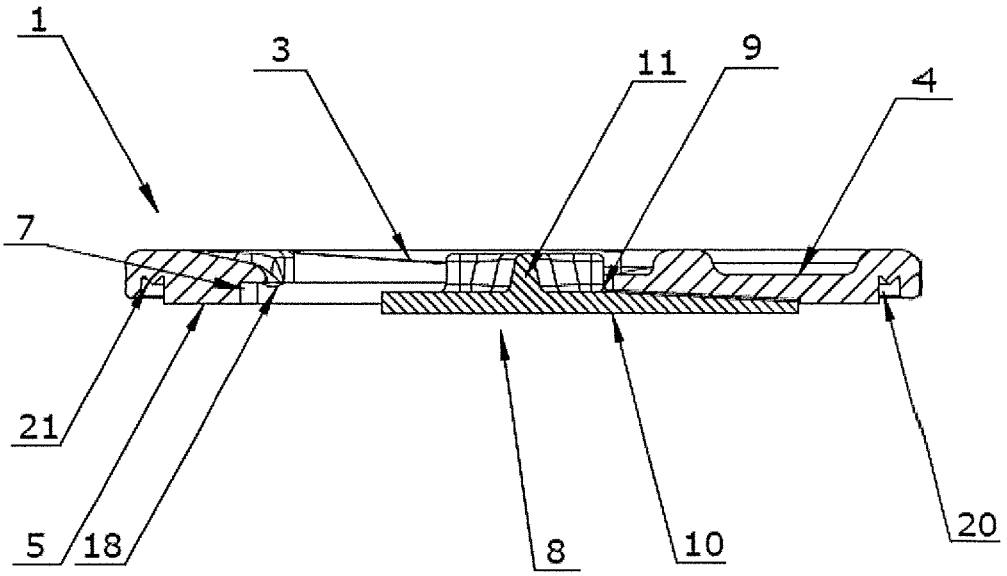
Figure 8C:
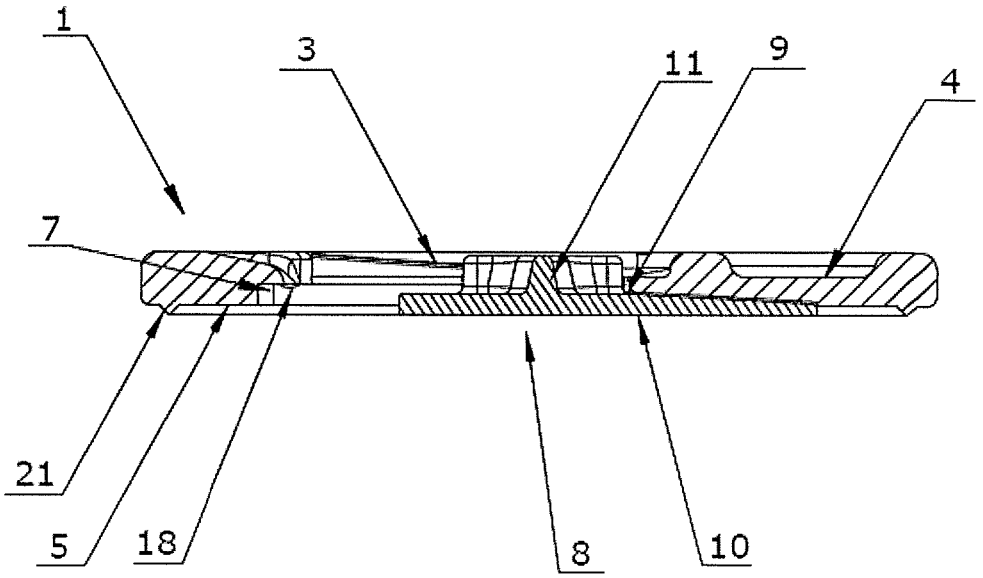
Figure 8D:
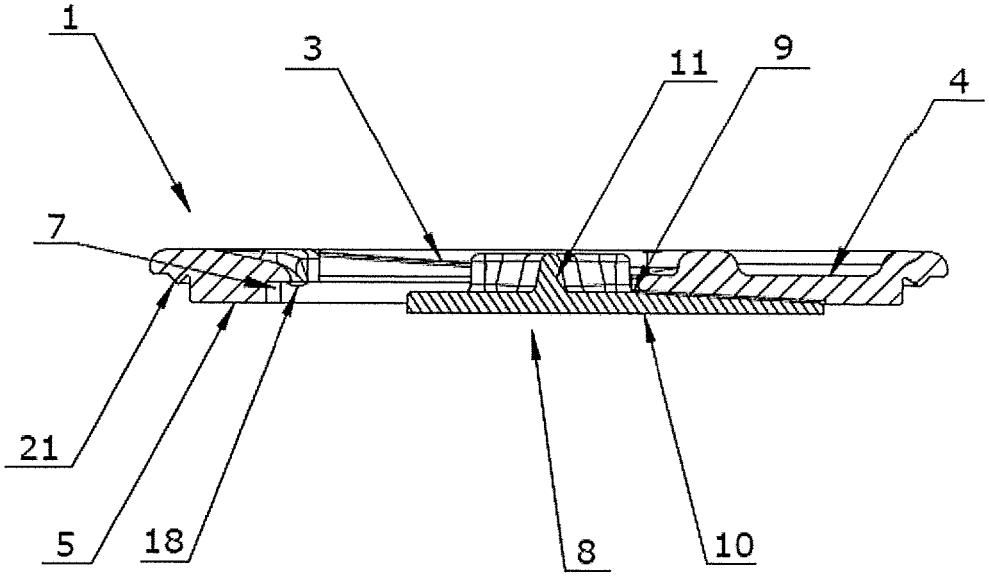
Figure 9:
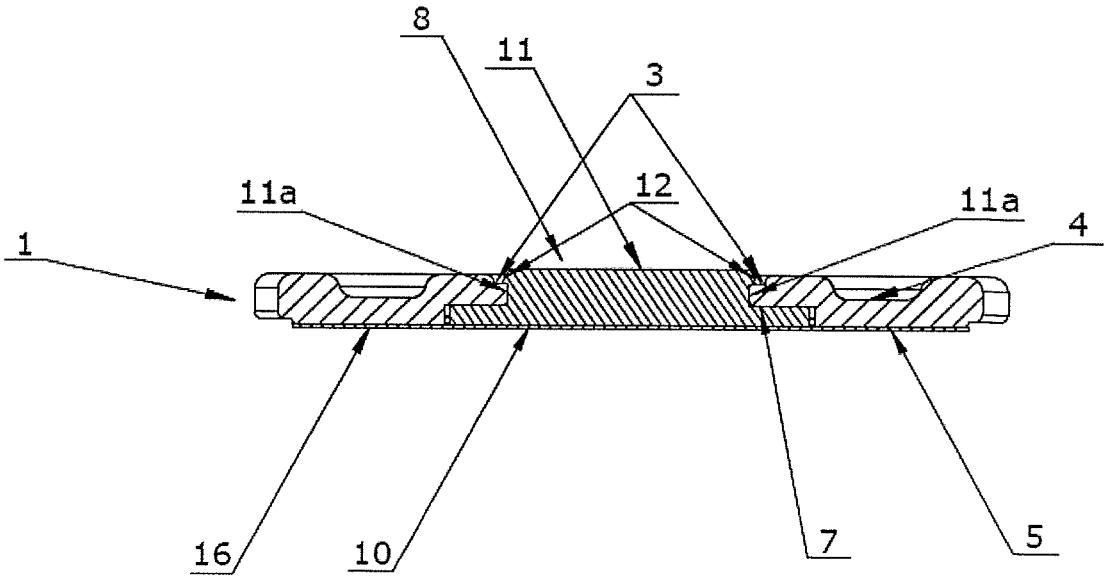
FIG. 9 presents the lid with the opening for emptying the container in the closed position, in cross section across the guides.
Figure 10:
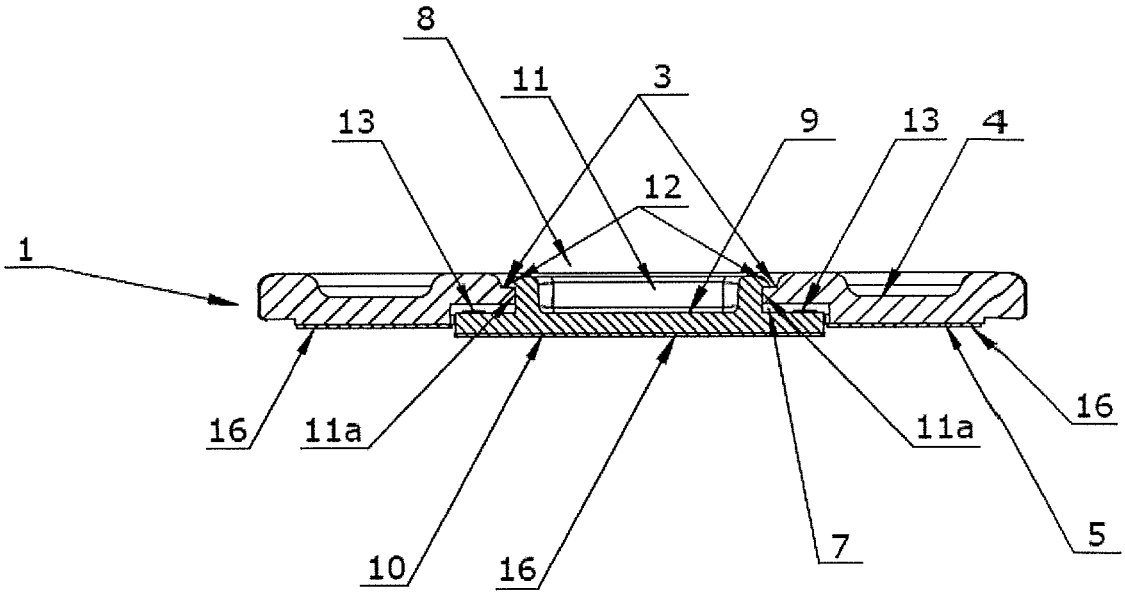
FIG. 10 depicts the lid with the opening for emptying the container in the open position, in cross section across the guides.

In all embodiments described above, formed on the bottom surface 5 of the panel 1, around its circumferential rim, may be groove 20 for non-detachable connection between the lid and the container by way of ultrasonic welding. The bottom 20*a* of the groove 20 may be flat, as shown in FIG. 8A, or may feature an energy director 21 shaped thereon, preferably triangular in cross section, as shown in FIG. 8B, suitable for ultrasonic welding. In another embodiment, formed on the bottom surface 5 of the panel 1, around its circumferential rim, is an energy director 21, preferably triangular in cross section, as shown in FIG. 8C and FIG. 8D, suitable for ultrasonic welding.

The described lid may be made of the same plastic.

Figure 4:
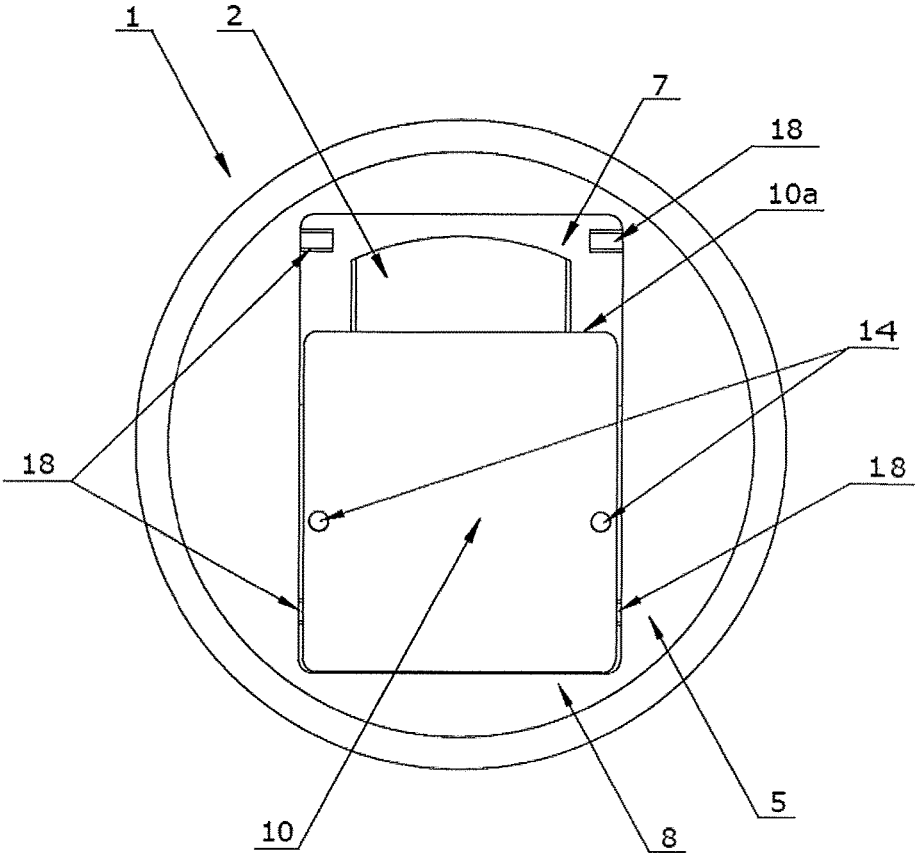
FIG. 4 presents the lid with the opening for emptying the container in the open position, in a view from the bottom.
Figure 5:
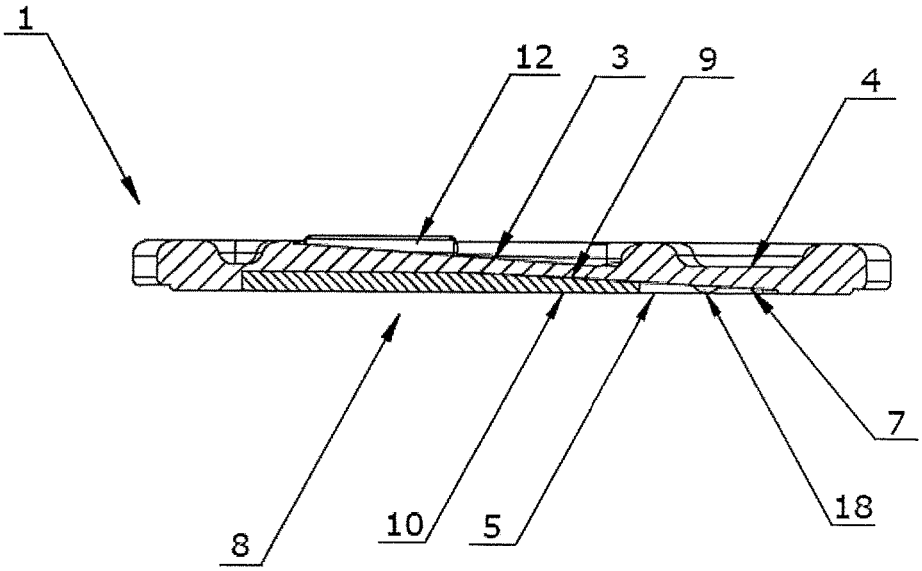
FIG. 5 depicts the lid with the opening for emptying the container in the closed position, in longitudinal section across the guide.
Figure 6:
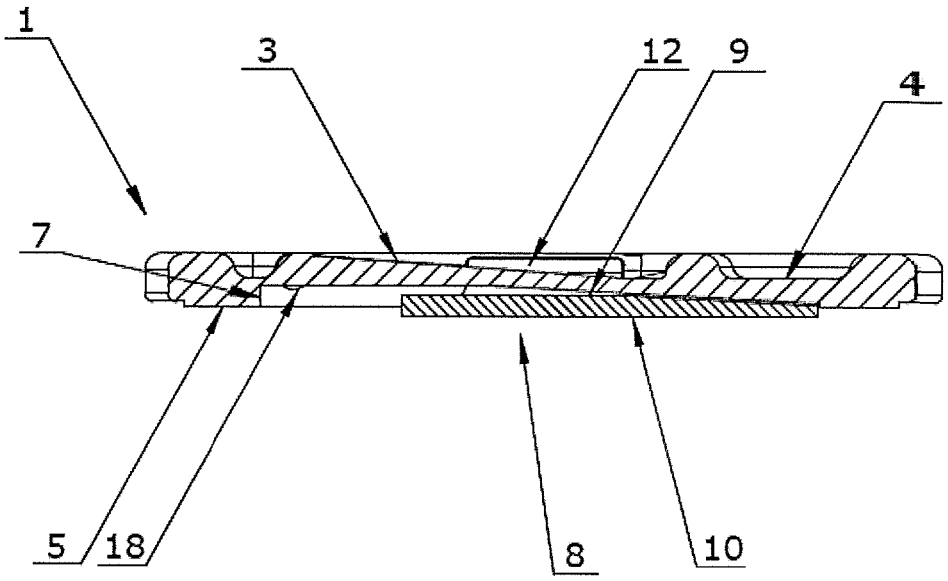
FIG. 6 shows the lid with the opening for emptying the container in the open position, in longitudinal section across the guide.
Figure 7:
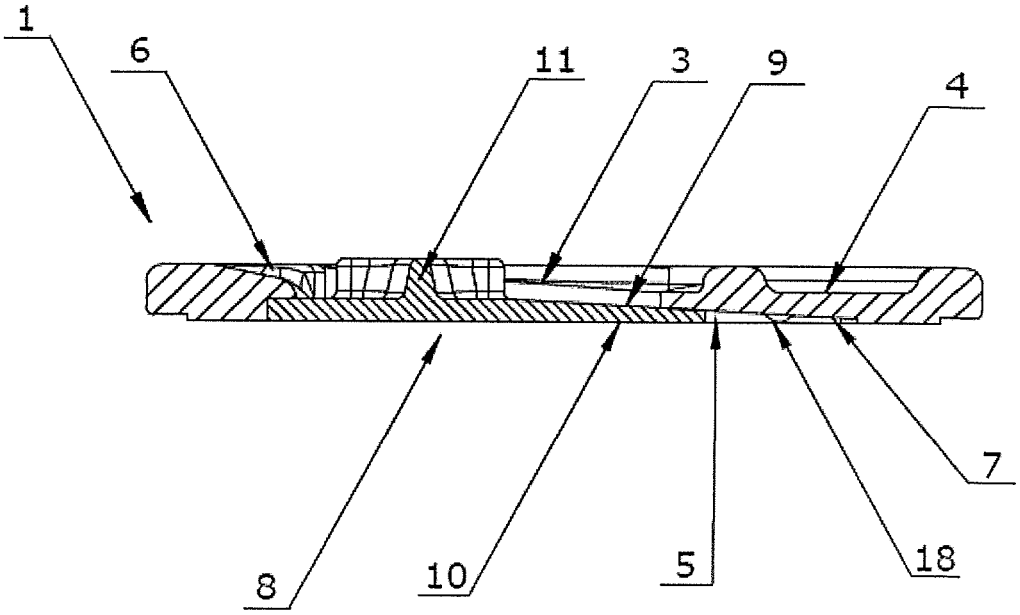
FIG. 7 depicts the lid with the opening for emptying the container in the closed position, in longitudinal section in between the guides.

In order to open the opening 2 for emptying the container one slides the slide piece 8 using the pull tab 11, where the slide piece 8 simultaneously moves down with respect to the panel 1, eliminating friction between the top surface 9 of the slide piece 8 and the bottom surface 5 of the panel 1. If there is foil 16 fixed to the bottom surface 5 of the panel 1 and to the bottom surface 10 of the slide piece 8, initiation of the movement of the slide piece 8 causes breaking of the sealing foil 16 along the perforation 17. In between the perforations, the foil 16 remains fixed to the bottom surface 10 of the slide piece 8, and the remaining part of the foil 16 remains fixed to the bottom surface 5 of the panel 1. When the opening 2 for emptying the container is open, the openings 13 in the panel 1 and the openings 14 in the slide piece 8 overlap, thus forming ducts which supply air to the container, and the corresponding two locking protrusions 18 of the panel 1 are positioned in the respective two locking hollows 19 of the slide piece 8, as shown in FIG. 4, thus securing the slide piece against undesirable movement. The opening 2 may be reclosed by shifting the slide piece 8 using the pull tab 11 back to its original position, in which case the openings 13 in the panel 1 are screened by the slide piece 8, and the corresponding two locking protrusions 18 of the panel 1 are positioned in the two corresponding locking hollows 19 of the slide piece 8, as shown in FIG. 3, thus securing the slide piece against undesirable movement.

LIST OF NUMERICAL REFERENCES

1—panel
2— opening for emptying the container
2*a*— longitudinal walls of the opening
2*b*— transverse edge of the opening
3, 103— guides
4—top surface of the panel
5—bottom surface of the panel
6— outflow lip
7—recess on the slide piece
8—slide piece
9—sop surface of the slide piece
10—bottom surface of the slide piece
11—pull tab
11*a*—opposite side walls of the pull tab
12, 12*a*, 112, 112*a*— catches
13—openings in the panel, ensuring the flow of air
14—openings in the slide piece, ensuring the flow of air
15—spikes of the slide piece
16—foil
17— foil perforation
18—locking element of the panel
19—locking element of the slide piece
20—groove
20*a*— groove bottom
21—energy director
22—catches on the bottom surface of the panel
23—guides on the bottom surface of the slide piece

The invention claimed is:

1. A container lid comprising a panel (1) with an opening (2) for emptying the container, wherein formed on 41 two opposite walls (2*a*) of said opening (2) are guides (3, 103) declining towards a bottom surface (5) of the panel (1), and further having a slide piece (8) with catches (12, 12*a*, 112, 112*a*) formed on a top surface (9) of the slide piece declining towards the top surface (9) of the slide piece, said slide piece (9) further featuring a pull tab (11), wherein said catches (12, 12*a*, 112, 112*a*) are fitted slidingly in said guides (3, 103), wherein the pull tab (11) is formed on the top surface (9) of the slide piece (8), wherein there is a recess (7) to accommodate the slide piece (8) formed on the bottom surface (5) of the panel (1) around the opening (2) for emptying the container, and wherein formed in said recess (7) is at least one locking element (18) and formed on the slide piece (8) is at least one locking element (19), so that said locking element (18) of the panel (1) and said locking element (19) of the slide piece (8) fit each other forming a pair.

2. The lid according to claim 1, wherein a bottom surface (10) of the slide piece is flat, and the bottom surface (5) of the panel (1) is flat at least in a portion around the recess (7).

3. The lid according to claim 1, wherein formed on the bottom surface (1) of the slide piece (8) are guides (23), and formed on the bottom surface (5) of the panel (1) are catches (22) which are fitted slidingly in said guides (23).

4. The lid according to claim 1, wherein the guides (3) formed on the two opposite walls (2) in the opening (2) run askew with respect to the bottom surface (5) of the panel (1), and the catches (12, 12*a*) formed on the top surface (9) of the slide piece (8) run askew with respect to the top surface (9) of the slide piece (8).

5. The lid according to claim 1, wherein the guides (103) formed on the two opposite walls (2*a*) in the opening (2) and the catches (112, 112*a*) formed on the top surface (9) of the slide piece (8) are arched shape.

6. The lid according to claim 1, wherein the catches formed on the top surface (9) of the slide piece (8) are segmented (12*a*, 112*a*).

7. The lid according to claim 1, wherein the catches (12, 12*a*, 112, 112*a*) on the top surface (9) of the slide piece (8) are formed on an opposite side walls (a) of the pull tab (11).

8. The lid according to claim 2, wherein fixed to the bottom surface (10) of the slide piece (8) and the flat part of the bottom surface (5) of the panel (1) around the recess (7) is plastic foil (16) with a perforation (17) at least along the longitudinal edges of the slide piece (8).

9. The lid according to claim 8, wherein there are spikes (15) on the bottom surface (10) of the slide piece, along the edge (10*a*) transverse with respect to the direction in which the slide piece (8) moves.

10. The lid according to claim 1, wherein the locking element (19) of the slide piece (8) is hollow, and the matching locking element (18) of the recess (7) in the panel (1) is a protrusion.

11. The lid according to claim 1, wherein the panel (1) features at least one opening (13) to ensure the flow of air.

12. The lid according to claim 11, wherein the slide piece (8) features at least one opening (14) to ensure the flow of air, which overlaps said opening (13) in the panel (1), wherein the opening (2) for emptying the container is uncovered.

13. The lid according to claim 1, wherein formed on the bottom surface (5) of the panel (1) around its circumferential edge is a groove (20).

14. The lid according to claim 13, wherein a bottom (20*a*) of the groove (20) is flat.

15. The lid according to claim 13, wherein there is an energy director (21) formed on the bottom (20*a*) of the groove (20), triangular in cross section.

16. The lid according to claim 1, wherein formed on the bottom surface (5) of the panel (1) around its circumferential edge is an energy director (21), triangular in cross section.

17. The lid according to claim 1, wherein formed on the top surface (4) of the panel (1) is an outflow lip (6).

* * * * *